United States Patent [19]

Montle

[11] Patent Number: 4,547,426

[45] Date of Patent: Oct. 15, 1985

[54] UPHOLSTERY WELT CORD

[75] Inventor: Robert E. Montle, Wyoming, Mich.

[73] Assignee: Sackner Products, Inc., Grand Rapids, Mich.

[21] Appl. No.: 705,360

[22] Filed: Feb. 25, 1985

[51] Int. Cl.[4] ..... D02G 3/00; D04C 1/02; D04C 1/06

[52] U.S. Cl. ..... 428/377; 57/210; 57/904; 87/2; 87/6; 87/7; 87/29; 428/376; 428/379; 428/398

[58] Field of Search ..... 428/375, 379, 377, 398, 428/376, 373, 365; 57/210, 904; 87/1, 2, 7, 6, 29

[56] References Cited

U.S. PATENT DOCUMENTS

| | | | |
|---|---|---|---|
| 2,979,982 | 4/1961 | Weitzel | 87/6 |
| 3,129,631 | 4/1964 | Hill et al. | 87/6 |
| 3,876,495 | 4/1975 | Esler | 428/398 |
| 4,093,773 | 6/1978 | Danko | 428/376 |

*Primary Examiner*—Lorraine T. Kendell

*Attorney, Agent, or Firm*—Price, Heneveld, Huizenga & Cooper

[57] ABSTRACT

A welt cord includes a core made of a polymeric, flexible material and enclosed within a cellulose cover. A heat conductive filament is enclosed within the polymeric core and extends the length of the cord. The cellulose cover is held on the polymeric core by a jacket of threads.

6 Claims, 3 Drawing Figures

UPHOLSTERY WELT CORD

BACKGROUND OF THE INVENTION

The present invention relates to fire resistant welt or beading cords used in upholstery.

The furniture industry has been under self-imposed pressure to improve the fire resistance of upholstered furniture and, therefore, examined carefully the fire resistance characteristics of each component of upholstered furniture, including the welt cords. Foremost in this examination is the resistance to ignition by burning cigarettes or cigars which cause most upholstery fires.

There are two basic kinds of welt cords. One type is an extruded foam plastic bead. The fire resistance of the plastic bead was increased by enclosing a wire within and along the length of the bead to conduct heat away from a burning cigarette placed on the bead so that the plastic material near the burning cigarette will tend not to be heated to its ignition temperature. However, the welt containing the plastic bead, even though the bead is foamed, is fairly hard to the touch and, therefore, undesirable. The welt is supposed to be fairly innocuous to the touch.

Another kind of welt cord is made of cellulose filler material with a braided jacket. The cellulose welt cord has been made more fire resistant by incorporating a strip of foil into the cord along its longitudinal length to conduct heat away from a point source of heat such as a cigarette so that the cellulose near the source will not reach ignition temperature. The foil strip, however, is not resilient and has very little memory. As a result, it crimps when the cord is bent, distorting the cross-sectional shape of the bent cord at the bend. Thus, when the welt cord is bent around the cushion or couch corner, for example, the welt cord will bulge at the bend, making the welt look irregular and sloppily installed.

In one prior art cellulose construction as disclosed in U.S. patent application Ser. No. 530,416 filed on Sept. 8, 1983, entitled UPHOLSTERY WELT CORD, a small diameter foamed plastic bead was incorporated into the center of a cellulose-type welt cord with an aluminum foil layer located between the cellulose and the foam bead. When such a cord is bent the foam assists in holding the shape of the welt cord because the "memory" of the plastic core tends to restore the cord to substantially its original cross-sectional shape after bending. However, this design is not completely satisfactory in retaining the shape of the welt cord. Further, it does not eliminate another problem with the use of foils, i.e., the foil tends to break as it is being drawn into the welt cord during manufacturing. Breakage can be greatly minimized by drawing the foil slowly into the cord, but this increases production time and costs. In addition, the braiding apparatus and method is complicated by running a number of elements through the braider.

SUMMARY OF THE INVENTION

The welt cord of the present invention is fire resistant cellulose type welt cord which can be quickly manufactured, and will not distort greatly when bent. The result is a welt cord which is inexpensive to manufacture, yet soft to the touch when enclosed in the welt. The cord includes a cellulose cover made by wadded cellulose tissue material enclosing a core made of a flexible polymeric material having a heat conductive filament extending the length of the cord within the polymeric core. The cellulose cover is held on the core by a jacket of threads wound around the cover.

DETAILED DESCRIPTION OF THE PREFERRED EMBODIMENT

Figure 2:
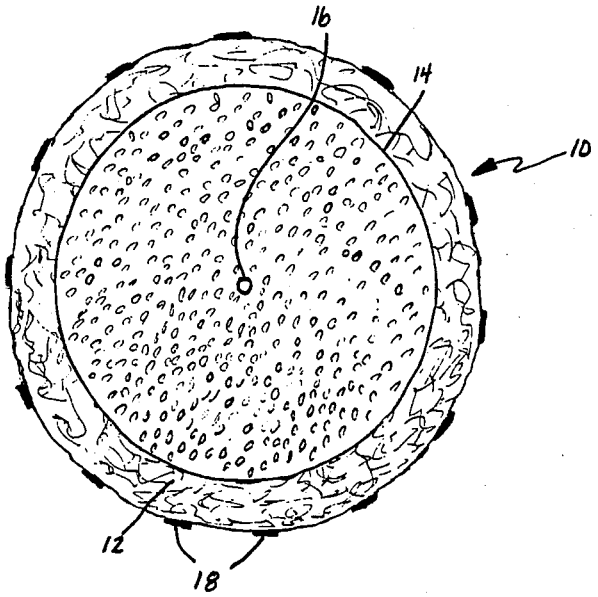
FIG. 2 is a cross-sectional view taken along the plane of line II—II of FIG. 1.

The welt cord 10 (FIGS. 1 and 2) of the present invention includes a cellulose outer cover 12 which receives and encloses a core 14 made of a polymeric material which has a heat connductive filament 16 extending the length of welt cord 10 within core 14. The cellulose cover is held on the core by a jacket of threads 18 which are wound around the cord. When a smoldering object, such as a cigarette, is placed against the welt cord, the cigarette will slowly burn through threads 18 and cellulose body 12 in the region of the smoldering cigarette and will melt a small section of core 14. However, when the heat of the cigarette reaches heat conductive filament 16, the heat of the cigarette is dissipated along filament 16 such that the materials in the region of the heat source will not reach a temperature where they will ignite.

Cellulose body 12 is made of a wadded cellulose tissue material. The material includes layered sheets of thin, crepe cellulose tissue wadded and wrapped in a cylinder around core 14 and retained in the cylindrical shape by jacket threads 18 wound around cord 10.

Core 14 is made of a polymeric material. Preferably, core 14 is made of a foamed polymeric material such as polyethlyene which is formed by mixing pallets of polymeric matterial with a suitable blowing agent. The mixture is then heated to a temperature sufficient to decompose the flowing agent completely, and thereafter the mixture is extruded in a well-known way through a die having a circular cross section to produce the core with a circular cross section and having a density of approximately 0.3 grams per cubic centimeter and a percent of voids of approximately 56 percent. This method or methods are described in greater detail in U.S. Pat. No. 3,876,495, the disclosure of which is incorporated herein by reference.

Filament 16 is made of metal, preferably copper, so that it conducts heat away from a point source of heat. Filament 16 can be drawn through the extruder at the same time core 14 is being extruded. Such a method of extrusion is disclosed in U.S. Pat. No. 3,876,495 except that the polyester reinforcing fibers disclosed in the patent are substituted with the copper filament 16. More than one copper filament can be provided. In fact, it is preferred to have at least two copper filaments, each of which is from about 0.007 to about 0.010 of an inch in diameter.

Jacket threads 18 are, in the preferred embodiment, glass fibers which last a long time, and do not dry out and become brittle if the upholstery is washed. Fibers 18 could be made of cotton or any other similar material as well.

Figure 1:
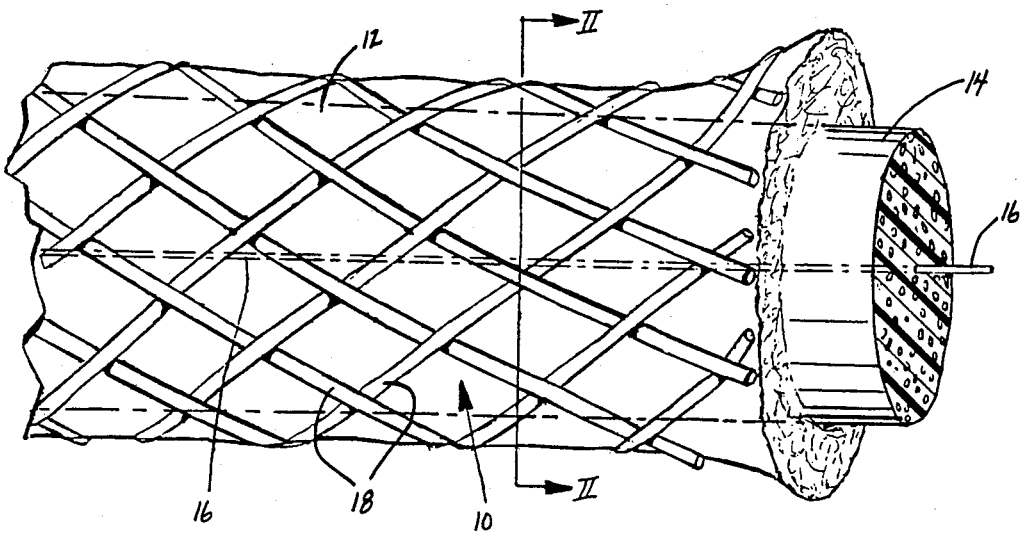
FIG. 1 is a side elevational view of a section of the welt cord made in accordance with this invention.

The relative dimensions of body 12, core 14, filament 16 and threaded jacket 18 are substantially as shown in FIGS. 1 and 2. As indicated above, there are preferably two filaments 16, each of which is 0.007 to 0.010 of an inch in diameter, preferably 0.009 of an inch in diameter. Core 14 is preferably about 4/32 of an inch in diameter, and the cellulose body 12 is about 0.015 to about 0.031 of an inch thick. Thus, the overall diameter of the cord will range from 5/32 to about 6/32 of an inch. These dimensions correspond to a welt cord wherein the core diameter is about four to about eight times as thick as the thickness of the wadded cellulose body covering the core. And the filaments are each about 0.072 times as thick as the core. If a wide diameter of cord is desired, these relative measurements can be proportionally increased.

Figure 3:
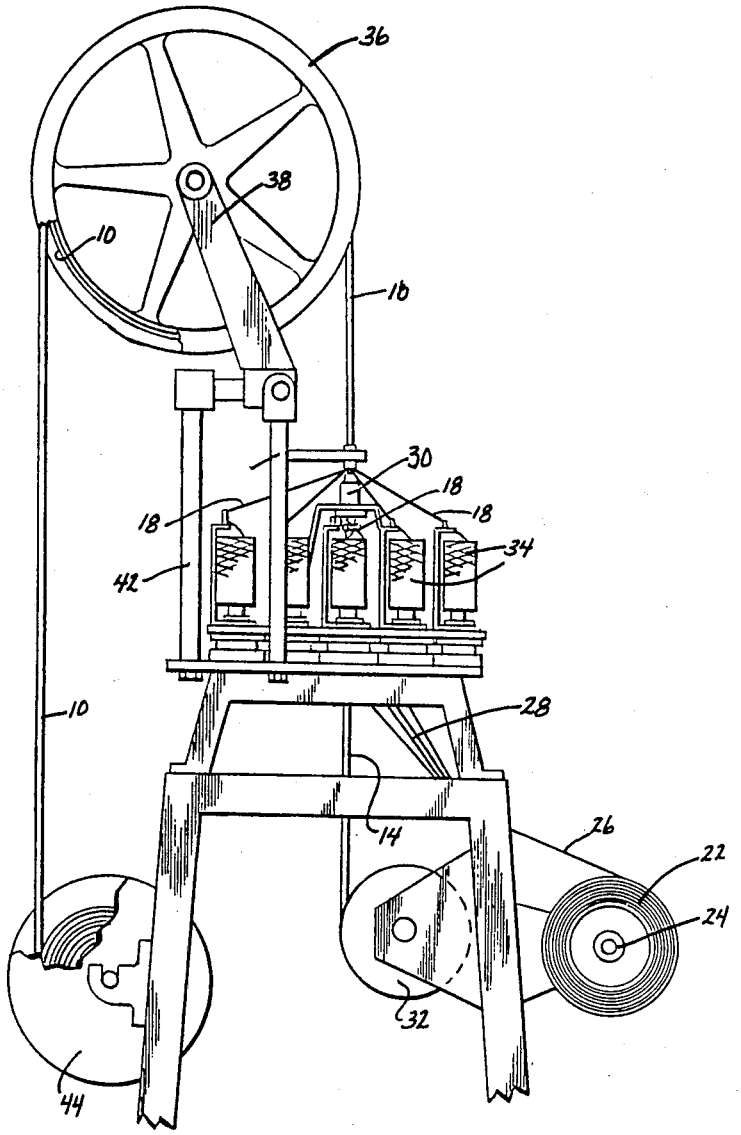
FIG. 3 is an elevational view of an apparatus for construction of the cord of FIGS. 1 and 2.

A machine for manufacturing the welt cord of the present invention is illustrated in FIG. 3. Such a machine is similar to the one described in U.S. Pat. No. 2,741,149, the disclosure of which is incorporated herein by reference. The winding machine 20 includes a cellulose wadding roll 22 mounted on a spindle 24 for rotatably supporting roll 22. A strip of cellulose material 26 is unwound from roll 22 and is crumpled and creped, as illustrated at 28 and drawn upwardly to a compressing eye 30.

A core roll 32 carries the wound polymeric core 14 with filaments 16 (not shown) therein. Core 14 is unwound from roll 32 and pulled through compressing eye 30 through which the crumpled cellulose strip 26 is also pulled through compressing eye 30 to form body 12. As core 14 and cellulose strip 26 are being pulled through eye 30, threads 18 are unwound from spools or bobbins 34 which are driven in a conventional manner to braid threads 18 on cellulose body 12 to form a threaded jacket in a conventional manner. Cellulose strip 26, core 14 and the threads 18 are pulled through eye 30 by a capstan 36 around which the completed, braided cord 10 is wound at least one complete wrap. Capstan 36 is supported by bracket 38 carried by posts 40 and 42. The completed cord is then wound on a spool 44 for shipment and sale.

Further description of winding machine 20 is unnecessary because machines of this type are known in the art, are conventional, and are described in detail in U.S. Pat. No. 2,741,149. One thing should be realized at this point, however. The conductive filament 16 is protected from breakage within core 14 such that the machine can be run at a comparatively high rate of speed. Breakage of the cord materials is greatly minimized even when the product is rapidly manufactured.

Furthermore, the cord construction of the present invention does not deform greatly when bent around a corner. Core 14 has memory such that it can be bent around a corner, yet retain substantially the same cross-sectional shape it had prior to bending. Thus, the inner cord materials will not force the cellulose body to bulge excessively when the core is bent, so that a smooth, continuous cord shape is maintained. Finally, little or not sacrifice is made in the softness of the cord since it includes a cellulose body enclosing the polymeric core.

Having described the preferred embodiment of the invention, it will be understood to those skilled in the art that modifications may be made without departing from the spirit and broader aspects of the invention.

The embodiments of the invention in which an exclusive property or privilege is claimed are defined as follows:

1. A fire resistant welt cord for upholstery, comprising:

a core made of a flexible polymeric material and extruded in cylindrical cross section;

a cover made of crepe sheets of cellulose wadding and surrounding said core;

a jacket of threads wrapped around said body and holding said cover on said core; and a filament made of a heat conductive material located within said core and extending the longitudinal length of said core; whereby a point source of heat placed against said cord will be dissipated by said filament conducting heat away from said point source, said core will maintain the shape of said core when bent around corners and said cover provides a softness to touch.

2. The welt cord as recited in claim 1 wherein said core is about four to about eight times as thick as said cover covering said core.

3. The welt cord as recited in claim 2 wherein said core is made of a foamed polymeric material.

4. The welt cord as recited in claim 2 wherein said core is made of a foamed polymeric material having a density of approximately 0.3 grams per cubic centimeter.

5. The welt cord as recited in claim 1 wherein said filament comprises at least one metal wire.

6. The welt cord as recited in claim 1 wherein said filament comprises two strands of copper wire, each at least being 0.072 times as thick as the diameter of said core.

* * * * *